US005782112A

United States Patent [19]

White et al.

[11] Patent Number: 5,782,112

[45] Date of Patent: Jul. 21, 1998

[54] AUTO-INJECTION SIPHON BREAK FOR WASHERS

[76] Inventors: Wm Wallace White, 2401 Minerva St.; Christopher G. Hoppe, 214 S. Eagle St., both of Oshkosh, Wis. 54901

[21] Appl. No.: 744,503

[22] Filed: Nov. 7, 1996

[51] Int. Cl.[6] ..... E03C 1/10

[52] U.S. Cl. ..... 68/207; 137/216; 137/896

[58] Field of Search ..... 137/216, 896; 68/207

[56] References Cited

U.S. PATENT DOCUMENTS 4,369,806 1/1983 Noren ..... 137/216

*Primary Examiner*—Gerald A. Michalsky

*Attorney, Agent, or Firm*—Marshall, O'Toole, Gerstein, Murray & Borun

[57] ABSTRACT

A siphon break for a washing machine comprises a siphon body and a reservoir. The siphon body includes first and second openings arranged to receive fill water, a third opening arranged to direct fill water from the first opening to a tub of the washing machine, a fourth opening arranged to siphon overflow water from the siphon body, and a siphon body mounting device arranged to mount the siphon body to the washing machine. The reservoir includes a first opening arranged to receive a chemical, a second opening arranged to spill a mixture of water and the chemical to the siphon body, and a reservoir mounting device arranged to mount the reservoir to the washing machine so that the reservoir is mounted separately from the siphon body and so that the reservoir receives water from the second opening of the siphon body.

34 Claims, 5 Drawing Sheets

AUTO-INJECTION SIPHON BREAK FOR WASHERS

TECHNICAL FIELD OF THE INVENTION

The present invention is directed to a siphon break for an appliance and, more particularly, to an auto-injection siphon break for washing machines.

BACKGROUND OF THE INVENTION

A siphon break of a clothes washing machine typically performs a number of functions. First, the siphon break receives fill water from one or more water fill hoses and directs the fill water to the wash tub of the washing machine through a tub hose connected between a drain of the siphon break and the wash tub. Second, the siphon break has an opening above its drain in order to siphon away overfill water that backs up into the siphon break from the wash tub through the tub hose between the siphon break and the wash tub. Third, some siphon breaks are arranged to receive chemicals, such as bleaches, detergents, softeners, and the like, which are directed by the siphon breaks to the wash tubs though their drains and the tub hoses connected thereto.

When such chemicals are supplied to the siphon break, the full concentrations of these chemicals are supplied through chemical supply hoses and are dumped directly onto the body of the siphon break. The supply of chemicals directly to the body of a siphon break is particularly troublesome because the chemicals tend to drip on the body of the siphon break during periods of machine non-use when water is not available to dilute and flush the chemicals away. These highly concentrated chemicals, consequently, degrade the siphon break, and the chemical supply hoses connected thereto, requiring the siphon break and the chemical supply hoses to be periodically replaced.

However, servicing of the siphon break and the chemical supply hoses requires that (i) all of the water fill hoses, (ii) all of the chemical supply hoses, and (iii) the tub hose between the siphon break and the wash tub be detached from the siphon break in order to remove the siphon break and replace it. The amount of servicing required to detach all of these hoses is time consuming and costly.

The present invention is directed to a siphon break which solves one or more of the above noted problems.

SUMMARY OF THE INVENTION

According to a first aspect of the present invention, an arrangement for a washer comprises a directing means, a mixing means, and a mounting means. The directing means directs fill water from a first water inlet to a tub of the washer. The mixing means mixes a chemical with water from a second water inlet and for directing a mixture of the chemical and water to the directing means for supply to the tub. The mounting means mounts the mixing means and the directing means to the washer so that the mixing means may be removed from the washer separately from the directing means.

According to another aspect of the present invention, a siphon break for a washer comprises a siphon body, a water and chemical mixer, and first and second mounting devices. The siphon body is arranged to siphon away overflow water, and to direct fill water to a tub of the washer. The water and chemical mixer is arranged to mix a chemical with water, and to allow a mixture of the chemical and water to spill into the siphon body for supply to the tub. The first mounting device is arranged to mount the siphon body to the washer.

The second mounting device is arranged to mount the water and chemical mixer to the washer so that the water and chemical mixer may be removed from the washer without also removing the siphon body.

According to yet another aspect of the present invention, a siphon break for a washer comprises a siphon body and a reservoir. The siphon body includes (i) first and second openings arranged to receive fill water, (ii) a third opening arranged to direct fill water from the first opening to a tub of the washer, (iii) a fourth opening arranged to siphon overflow water from the siphon body, and (iv) a siphon body mounting device arranged to mount the siphon body to the washer. The reservoir includes (i) a first opening arranged to receive a chemical, (ii) a second opening arranged to discharge a mixture of water and the chemical to the siphon body, and (iii) a reservoir mounting device arranged to mount the reservoir to the washer so that the reservoir is mounted separately from the siphon body and so that the reservoir receives water from the second opening of the siphon body.

According to a further aspect of the present invention, a washer comprises a washer frame, a tub, a siphoning means, a mixing means, and a mounting means. The siphoning means siphons away overflow water from the tub, and directs fill water to the tub. The mixing means mixes a chemical with water, and allows a mixture of the chemical and water to spill into the siphoning means for supply to the tub. The mounting means mounts the siphoning means and the mixing means separately to the washer frame.

BRIEF DESCRIPTION OF THE DRAWINGS

These and other features and advantages of the present invention will become more apparent from a detailed consideration of the invention when taken in conjunction with the drawings in which.

DETAILED DESCRIPTION

Figure 1:
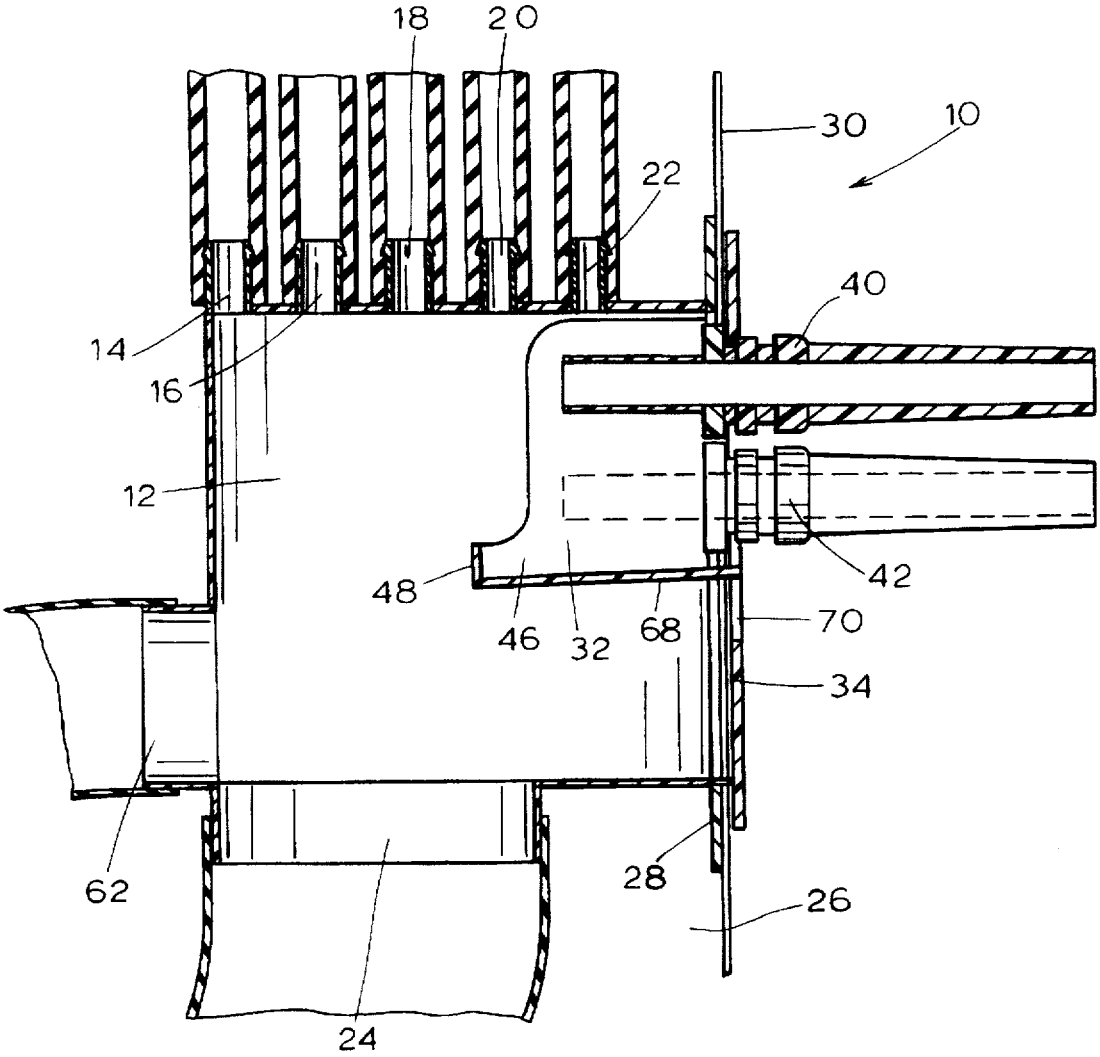
FIG. 1 is a side view of the siphon break according to the present invention.
Figure 2:
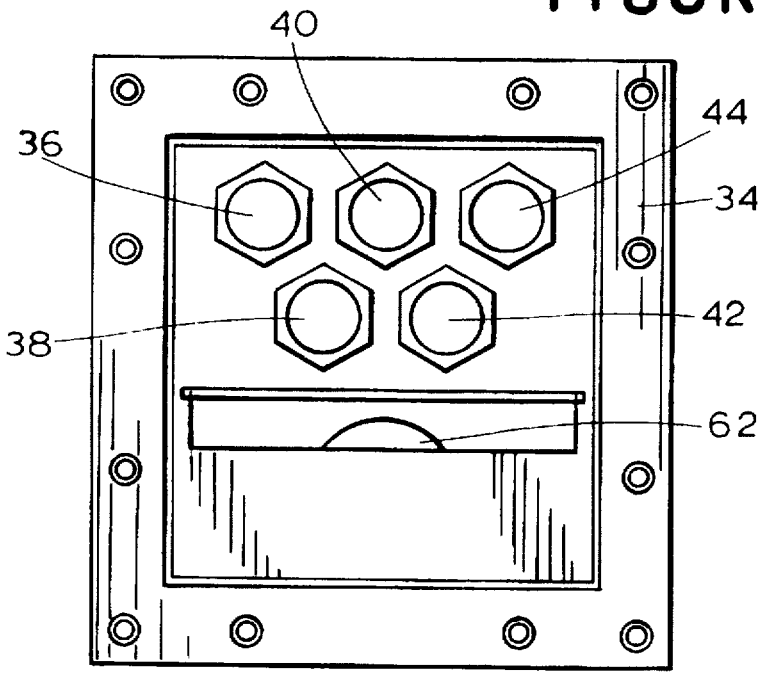
FIG. 2 is a rear view of the siphon break shown in FIG. 1.
Figure 3:
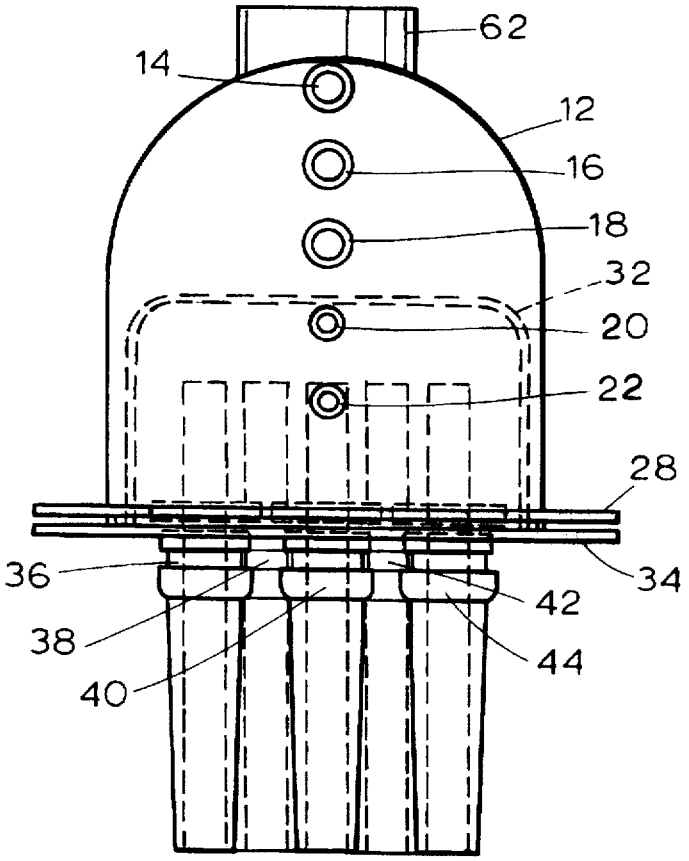
FIG. 3 is a top view of the siphon break shown in FIG. 1.

A siphon break 10 according to the present invention is illustrated in FIGS. 1–3. The siphon break 10 includes a siphon body 12 having water fill connectors 14, 16, 18, 20, and 22, and a drain connector 24. It should be understood that, with the cross-hatching of FIG. 3, the water fill connectors 14, 16, 18, 20, and 22 would not normally be seen in that view. However, the water fill connectors 14, 6, 18, 20, and 22 are shown in FIG. 3 in order to better illustrate the relationship between these connectors and the other features of the siphon break 10.

One of the water fill connectors 20 and 22 may be for cold water, and the other may be for hot water. Similarly, two of the water fill connectors 14, 16, and 18 may be for cold water, and the other for hot water. The water fill connectors 14, 16, 18, 20, and 22 are arranged to receive corresponding water fill hoses, and the drain connector 24 is arranged to receive a tub hose in order to direct water from the water fill hoses through the siphon body 12 and to the wash tub of a washing machine 26. The siphon body 12 also has a mounting plate 28 in order to mount the siphon body 12 to a panel 30 of the washing machine 26.

The siphon break 10 further includes a reservoir 32 which may alternatively be referred to as a mixing cup. The reservoir 32 has a mounting plate 34 so that the reservoir 32 can also be mounted to the panel 30 of the washing machine 26. As shown in FIG. 1, when the siphon body 12 and the reservoir 32 are mounted to the panel 30 of the washing machine 26, the reservoir 32 is positioned within the siphon body 12.

Auto-injection connectors 36, 38, 40, 42, and 44 are suitably attached to the mounting plate 34. The auto-injection connectors 36, 38, 40, 42, and 44 may be connected to chemical injection hoses and extend through the mounting plate 34 in order to discharge chemicals into a well 46 of the reservoir 32. As shown in FIGS. 2 and 3, the auto-injection connectors 36, 38, 40, 42, and 44 are staggered to reduce the possibility that they will drip chemicals on one another.

As shown in FIGS. 1 and 3, the water fill connectors 14, 16, 18, 20, and 22 are arranged so that the water fill connectors 14, 16, and 18 are over the siphon body 12 but not the reservoir 32, and so that the water fill connectors 20 and 22 are over the reservoir 32. Accordingly, the water fill hoses connected to the water fill connectors 20 and 22 dump water into the well 46 of the reservoir 32, and the water fill hoses connected to the water fill connectors 14, 16, and 18 dump water into the siphon body 12 of the siphon break 10 but not into the well 46 of the reservoir 32.

With this arrangement, the chemicals supplied through the auto-injection connectors 36, 38, 40, 42, and 44 are dispensed into the reservoir 32 where the chemicals are mixed with water supplied through the water fill connectors 20 and 22. When there is a sufficient mixture of water and chemicals in the reservoir 32, the mixture spills over a short front wall 48 of the reservoir 32 and falls into the siphon body 12 of the siphon break 10. The mixture then drains through the drain connector 24 and a tub hose connected thereto to the tub of the washing machine 26. The reservoir 32 may be flushed any time water is called for during a cycle of the washing machine 26. Because of the well 46 of the reservoir 32, the reservoir maintains a level of water therein in order to dilute any concentrated chemicals that drip from the auto-injection connectors 36, 38, 40, 42, and/or 44 during periods of non-use of the washing machine 26.

Figure 4:
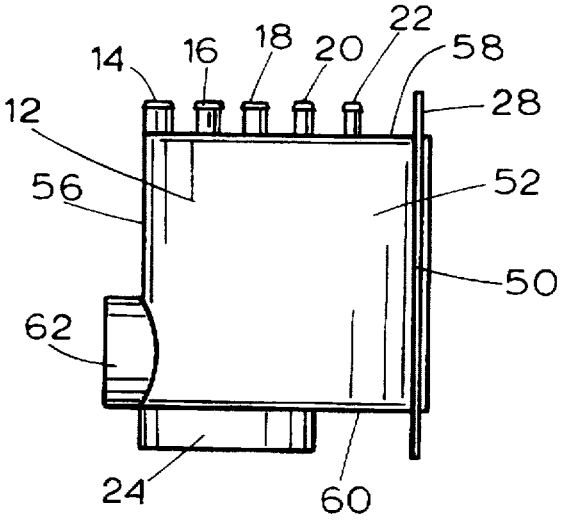
FIG. 4 is a side view illustrating a siphon body of the siphon break shown in FIG. 1.
Figure 5:
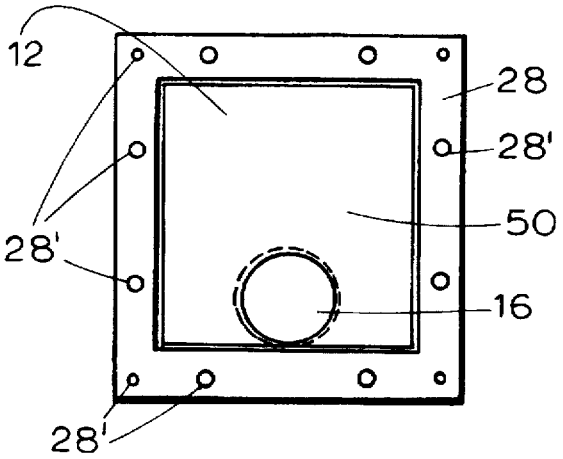
FIG. 5 is a rear view of the siphon body shown in FIG. 4.
Figure 6:
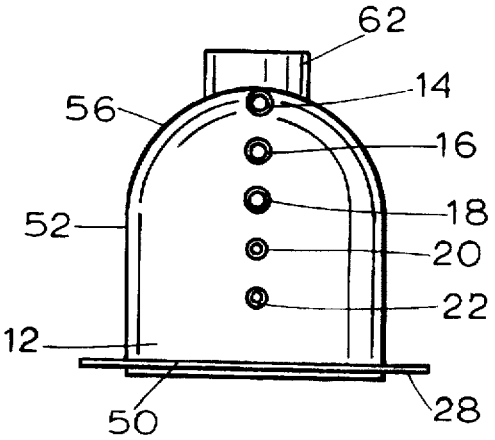
FIG. 6 is a top view of the siphon body shown in FIG. 4.

The siphon body 12 is shown in greater detail in FIGS. 4–6. As shown in FIG. 5, the mounting plate 28 of the siphon body 12 has an opening 50 therethrough in order to receive the reservoir 32. The opening 50 of the siphon body 12 corresponds to an opening in the panel 30 of the washing machine 26. The siphon body 12 has sides 52 and 54, and a rounded front wall 56 which extends between the sides 52 and 54. The siphon body 12 also has a top wall 58 through which the water fill connectors 14, 16, 18, 20, and 22 extend in order to communicate with the interior of the siphon body 12. The siphon body 12 has a floor 60 through which the drain connector 24 communicates with the interior of the siphon body 12 so that water and chemicals that fall toward the floor 60 may pass through the drain connector 24 and drain to the tub of the washing machine 26. The siphon body 12 may be provided with a detergent connector 62 which may be used instead of the auto-injection connectors 36, 38, 40, 42, and 44.

Figure 7:
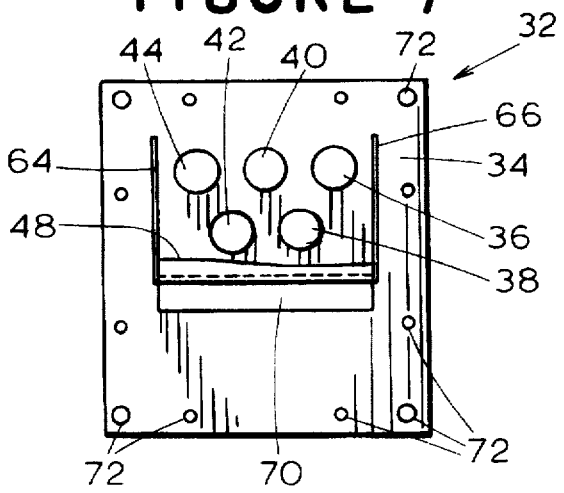
FIG. 7 is a front view illustrating a reservoir of the siphon break shown in FIG. 1.

The reservoir 32 is shown in greater detail in FIGS. 7–10. The front wall 48 of the reservoir 32 tapers from left to right as shown in FIG. 7. The reservoir 32 also has side walls 64 and 66 and a floor 68. The side walls 64 and 66, the front wall 48, the floor 68, and the mounting plate 34 form the well 46 which holds water during periods of non-use of the washing machine 26 so as to dilute any chemicals which drip from the auto-injection connectors 36, 38, 40, 42, and 44. The height of the front wall 48 determines the amount of water that is held in the reservoir 32 in order to dilute chemicals from the auto-injection connectors 36, 38, 40, 42, and 44 during periods when water is not otherwise flowing through the siphon break 10.

Figure 8:
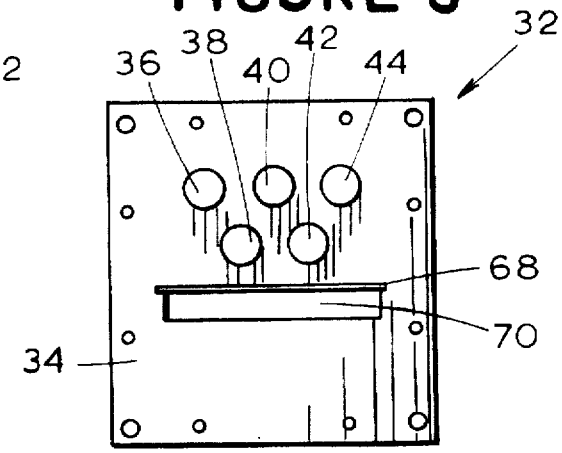
FIG. 8 is a rear view of the reservoir shown in FIG. 7.
Figure 9:
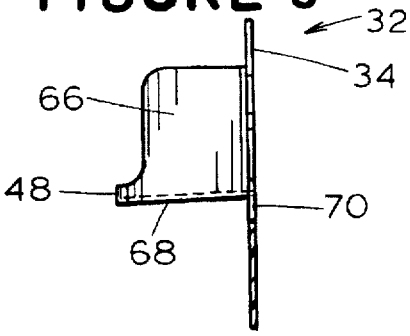
FIG. 9 is a side view of the reservoir shown in FIG. 7.
Figure 10:
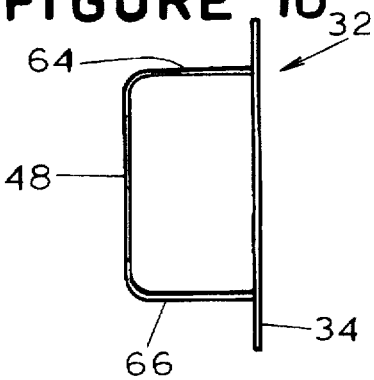
FIG. 10 is a top view of the reservoir shown in FIG. 7.

As shown in FIG. 8, the mounting plate 34 has a siphon opening 70 below the floor 68 of the reservoir 32 and above the drain connector 24 of the siphon body 12. Thus, a fluid path is established from the drain connector 24 to the siphon opening 70 through the interior of the siphon body 12, and through the opening 50 in the siphon body 12 and the corresponding opening in the panel 30. Accordingly, if water backs up from the tub of the washing machine 26 through the tub hose connected to the drain connector 24 and through the drain connector 24 into the siphon body 12 so that it rises up to the siphon opening 70, this overflow water siphons out of the siphon break 10 to an exterior of the washing machine 26. The dirty wash water is, accordingly, prevented from contaminating the potable fresh water. Also, the mounting plate 34 has suitable fastener receiving openings 72 for mounting the reservoir 32 to the panel 30 of the washing machine 26.

Figure 11:
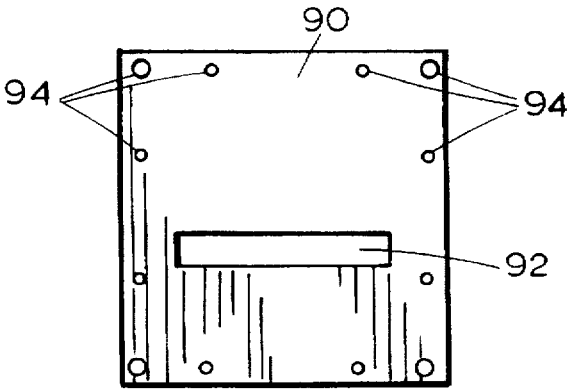
FIG. 11 illustrates a rear plate for use if a reservoir is not used in the siphon break shown in FIG. 1; and, FIG. 12 illustrates a washer having the siphon break of the present invention mounted thereto.

When the auto-injection connectors 36, 38, 40, 42, and/or 44 are in use, the detergent connector 62 is capped in order to prevent liquids and chemicals within the interior of the siphon body 12 from exiting the siphon body 12 through the detergent connector 62. However, if the detergent connector 62 is used instead of one or more of the auto-injection connectors 36, 38, 40, 42, and 44, the reservoir 32 and the auto-injection connectors 36, 38, 40, 42, and 44 are unnecessary. Accordingly, a rear plate 90 shown in FIG. 11 may be attached to the panel 30 of the washing machine 26 in place of the mounting plate 34 and the reservoir 32. The rear plate 90 has a siphon opening 92 which takes the place of the siphon opening 70 in the mounting plate 34. The rear plate 90 also has suitable fastener receiving openings 94 which may receive fasteners for fastening the rear plate 90 to the panel 30 of the washing machine 26.

The fastener receiving openings 28' of the mounting plate 28, the fastener receiving openings 72 of the mounting plate 34, and the fastener receiving openings 94 of the rear plate 90 may all correspond to one another and to suitable fastener receiving openings (not shown) through the panel 30 of the washing machine 26. Accordingly, when the auto-injection connectors 36, 38, 40, 42, and 44 are to be used instead of the detergent connector 62, the fastener receiving openings 28' of the mounting plate 28 are aligned with the fastener receiving openings 72 of the mounting plate 34. Suitable fasteners are then fitted through the aligned fastener receiving openings in order to fasten both the siphon body 12 and the reservoir 32 to the panel 30 of the washing machine 26. Also, the detergent connector 62 is capped.

On the other hand, when the detergent connector 62 is to be used instead of the auto-injection connectors 36, 38, 40, 42, and 44, the fastener receiving openings 28' of the mounting plate 28 are aligned with the fastener receiving openings 94 of the rear plate 90 in order to receive fasteners for fastening the siphon body 12 and the rear plate 90 to the panel 30 of the washing machine 26. In this case, the detergent connector 62 is not capped.

Alternatively, instead of aligning the fastener receiving openings 28' of the mounting plate 28 with the fastener receiving openings 72 of the mounting plate 34 so that the fastener receiving openings 28' and the fastener receiving openings 72 receive the same fasteners, the siphon body 12 and the reservoir 32 may be mounted to the panel 30 of the washing machine 26 by separate fasteners. Similarly, instead of aligning the fastener receiving openings 28' of the mounting plate 28 with the fastener receiving openings 94 of the rear plate 90 so that the fastener receiving openings 28' and the fastener receiving openings 94 receive the same fasteners, the siphon body 12 and the rear plate 90 may be mounted to the panel 30 of the washing machine 26 by separate fasteners.

In accordance with the present invention, if the reservoir 32 requires replacement because of deterioration due to the chemicals supplied through the auto-injection connectors 36, 38, 40, 42, and 44, the reservoir 32, which is a separate piece from the siphon body 12, may be separately replaced (i) without disconnecting the water fill hoses connected to the water fill connectors 14, 16, 18, 20, and 22, (ii) without disconnecting the tub hose from the drain connector 24, and (iii) without replacing the entire siphon break 10. Thus, when the reservoir 32 is to be replaced, the chemical injection hoses are removed from the auto-injection connectors 36, 38, 40, 42, and 44, the reservoir 32 is removed, and only the reservoir 32 is replaced by a replacement reservoir. The amount of labor required to service the siphon break 10 is, therefore, materially reduced, as is the number of parts which require detachment, reattachment, and replacement. Accordingly, service cost is materially reduced.

Figure 12:
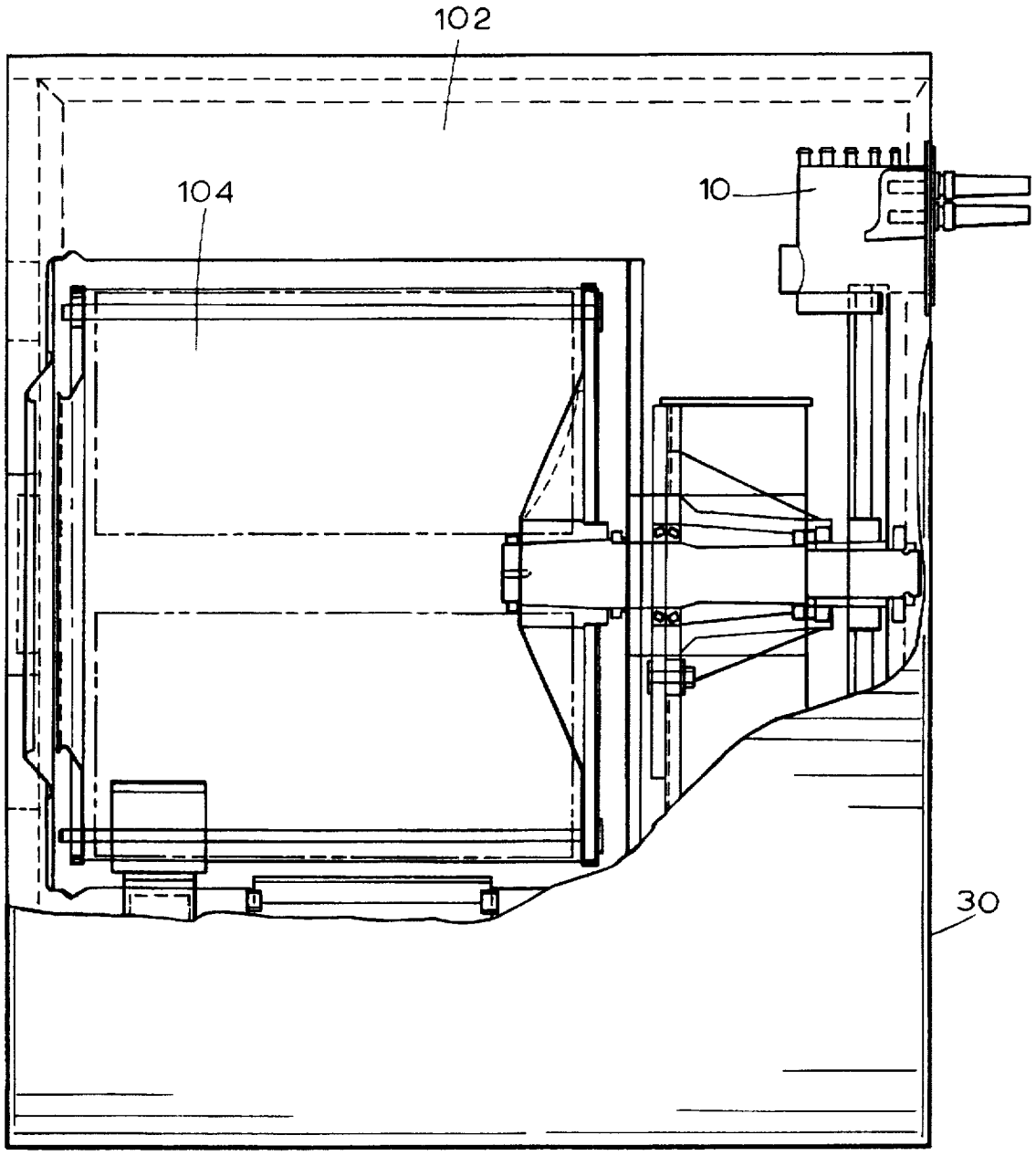

FIG. 12 shows a washing machine 100 having an enclosure 102 and a horizontal axis washing tub 104 within the enclosure 102. The panel 30 forms one wall of the enclosure 102, and the siphon break 10 is mounted to the panel 30.

Certain modifications of the present invention have been discussed above. Other modifications will occur to those practicing in the art of the present invention. For example, as described above, the mounting plate 28 and the mounting plate 34 are used to mount the siphon body 12 and the reservoir 32 to the panel 30 of the washing machine 26. Instead, brackets, rear walls of the siphon body 12 and the reservoir 32, or other mounting devices may be used to mount the siphon body 12 and the reservoir 32 to the panel 30 of the washing machine 26.

Moreover, the reservoir 32 may have other configurations than a well, mixing cup, reservoir, or the like provided that water and chemicals are suitably mixed and that undiluted chemicals are not allowed to contact the siphon body 12.

Furthermore, as described above, the siphon body 12 and the reservoir 32 are mounted to the panel 30 of the washing machine 26. However, the siphon body 12 and the reservoir 32 may be mounted to other parts of the washing machine 26, such as to other parts of the frame of the washing machine 26.

Accordingly, the description of the present invention is to be construed as illustrative only and is for the purpose of teaching those skilled in the art the best mode of carrying out the invention. The details may be varied substantially without departing from the spirit of the invention, and the exclusive use of all modifications which are within the scope of the appended claims is reserved.

What is claimed is:

1. An arrangement for a washer comprising:

directing means for directing fill water from a first water inlet to a tub of the washer;

mixing means for mixing a chemical with water from a second water inlet and for directing a mixture of the chemical and water to the directing means for supply to the tub; and, mounting means for mounting the mixing means and the directing means to the washer so that the mixing means may be removed from the washer separately from the directing means.

2. The arrangement of claim 1 wherein the mounting means is arranged to mount the mixing means within the directing means.

3. The arrangement of claim 2 wherein the directing means comprises first and second openings, wherein the first opening is below the second opening when the directing means is mounted to the washer, wherein the first opening is arranged to communicate with the tub, and wherein the second opening is arranged to siphon overflow water.

4. The arrangement of claim 3 wherein the mounting means is arranged to mount the mixing means above the first and second openings when the directing means is mounted to the washer.

5. The arrangement of claim 3 wherein the directing means comprises a water receiving opening and a chemical receiving opening, and wherein the water receiving opening and the chemical receiving opening are disposed to admit water and a chemical into the mixing means.

6. The arrangement of claim 5 wherein the water receiving opening is the first water inlet, and wherein a second water inlet is disposed to admit water into the directing means but not into the mixing means.

7. The arrangement of claim 1 wherein the directing means comprises first and second openings, wherein the first opening is below the second opening when the directing means is mounted to the washer, wherein the first opening is arranged to communicate with the tub, and wherein the second opening is arranged to siphon overflow water out of the directing means.

8. The arrangement of claim 7 wherein the mounting means is arranged to mount the mixing means above the first and second openings when the directing means is mounted to the washer.

9. The arrangement of claim 7 wherein the directing means comprises a water receiving opening and a chemical receiving opening, wherein the water receiving opening and the chemical receiving opening are disposed to admit water and a chemical into the mixing means, and wherein the mixing means is arranged to allow a mixture of water and a chemical to spill from the mixing means to the directing means.

10. The arrangement of claim 9 wherein the water receiving opening is the first water inlet, and wherein a second water inlet is disposed to admit water into the directing means but not into the mixing means.

11. The arrangement of claim 1 wherein the directing means comprises the first and second water inlets and a chemical receiving opening, wherein the first water inlet is disposed to admit water into the directing means but not into the mixing means, wherein the second water inlet is disposed to admit water into the mixing means but not directly into the directing means, wherein the chemical receiving opening is disposed to admit a chemical into the mixing means but not directly into the directing means, and wherein the mixing means is arranged to allow a mixture of water and a chemical to spill from the mixing means into the directing means.

12. The arrangement of claim 1 wherein the mixing means is arranged to allow liquid to spill from the mixing means to the directing means.

13. A siphon break for a washer comprising:

a siphon body, wherein the siphon body is arranged to siphon away overflow water, and wherein the siphon body is arranged to direct fill water to a tub of the washer;

a water and chemical mixer, wherein the water and chemical mixer is arranged to mix a chemical with water, and wherein the water and chemical mixer is arranged to allow a mixture of the chemical and water to spill into the siphon body for supply to the tub;

a first mounting device, wherein the first mounting device is arranged to mount the siphon body to the washer; and, a second mounting device, wherein the second mounting device is arranged to mount the water and chemical mixer to the washer so that the water and chemical mixer may be removed from the washer without also removing the siphon body.

14. The siphon break of claim 13 wherein the second mounting device is arranged to mount the water and chemical mixer within the siphon body.

15. The siphon break of claim 14 wherein the siphon body has first and second openings, wherein the first opening is below the second opening when the siphon break is mounted to the washer, wherein the first opening is arranged to communicate with the tub, and wherein the second opening is arranged to siphon away overflow water.

16. The siphon break of claim 15 wherein the second mounting device is arranged to mount the water and chemical mixer above the first and second openings when the siphon break is mounted to the washer.

17. The siphon break of claim 15 wherein the siphon body has a water receiving opening and a chemical receiving opening, and wherein the water receiving opening and the chemical receiving opening are disposed to admit water and a chemical into the water and chemical mixer.

18. The siphon break of claim 17 wherein the water receiving opening is a first water receiving opening, wherein the siphon body has a second water receiving opening, and wherein the second water receiving opening is disposed to admit water into the siphon body but not into the water and chemical mixer.

19. The siphon break of claim 13 wherein the second mounting device is arranged to releasibly mount the water and chemical mixer within the body.

20. The siphon break of claim 19 wherein the siphon body has first and second openings, wherein the first opening is below the second opening when the body is mounted to the washer, wherein the first opening is arranged to communicate with the tub, and wherein the second opening is arranged to siphon overflow water out of the siphon body.

21. The siphon break of claim 20 wherein the second mounting device is arranged to mount the water and chemical mixer above the first and second openings when the siphon break is mounted to the washer.

22. The siphon break of claim 20 wherein the siphon body has a water receiving opening and a chemical receiving opening, wherein the water receiving opening and the chemical receiving opening are disposed to admit water and a chemical into the water and chemical mixer, and wherein the water and chemical mixer is arranged to allow a mixture of water and a chemical to spill from the water and chemical mixer to the siphon body.

23. The siphon break of claim 22 wherein the water receiving opening is a first water receiving opening, wherein the siphon body has a second water receiving opening, and wherein the second water receiving opening is disposed to admit water into the siphon body but not into the water and chemical mixer.

24. A siphon break for a washer comprising:

a siphon body including first and second openings arranged to receive fill water, a third opening arranged to direct fill water from the first opening to a tub of the washer, a fourth opening arranged to siphon overflow water from the siphon body, and a siphon body mounting device arranged to mount the siphon body to the washer; and, a reservoir including a first opening arranged to receive a chemical, a second opening arranged to discharge a mixture of water and the chemical to the siphon body, and a reservoir mounting device arranged to mount the reservoir to the washer so that the reservoir is mounted separately from the siphon body and so that the reservoir receives water from the second opening of the siphon body.

25. The siphon break of claim 24 wherein the reservoir mounting device is arranged to mount the reservoir within the siphon body.

26. The siphon break of claim 25 wherein the third opening is below the fourth opening when the siphon break is mounted to the washer.

27. The siphon break of claim 26 wherein the reservoir mounting device is arranged to mount the reservoir above the third and fourth openings when the siphon break is mounted to the washer.

28. The siphon break of claim 26 wherein the first opening of the siphon body is not over the reservoir when the siphon body and reservoir are mounted to the washer, and wherein the second opening of the siphon body is over the reservoir when the siphon body and reservoir are mounted to the washer.

29. The siphon break of claim 24 wherein the reservoir mounting device is arranged to releasibly mount the reservoir within the siphon body.

30. A washer comprising:

a washer frame;

a tub:

siphoning means for siphoning away overflow water from the tub and for directing fill water to the tub;

mixing means for mixing a chemical with water and for allowing a mixture of the chemical and water to spill into the siphoning means for supply to the tub; and, mounting means for mounting the siphoning means and the mixing means separately to the washer frame.

31. The siphon break of claim 30 wherein the siphoning means comprises first and second openings, wherein the first opening is below the second opening when the siphon break is mounted to the washer, wherein the first opening is arranged to communicate with the tub, and wherein the second opening is arranged to siphon overflow water.

32. The siphon break of claim 31 wherein the mounting means is arranged to mount the mixing means above the first and second openings when the siphon break is mounted to the washer.

33. The siphon break of claim 31 wherein the siphon means comprises first and second water receiving openings, wherein the first water receiving opening is disposed to admit water directly into the mixing means but not into the siphoning means, and wherein the second water receiving opening is disposed to admit water directly into the siphoning means but not into the mixing means.

34. The siphon break of claim 30 wherein the siphoning means comprises first and second water receiving openings and a chemical receiving opening, wherein the first water receiving opening is disposed to admit water into the siphoning means but not into the mixing means, wherein the second water receiving opening is disposed to admit water into the mixing means but not into the siphoning means, wherein the chemical receiving opening is disposed to admit a chemical into the mixing means but not into the siphoning means, and wherein the mixing means is arranged to allow a mixture of water and a chemical to spill from the mixing means into the siphoning means.

* * * * *